US008235146B2

(12) United States Patent
Haugvaldstad et al.

(10) Patent No.: US 8,235,146 B2
(45) Date of Patent: Aug. 7, 2012

(54) ACTUATORS, ACTUATABLE JOINTS, AND METHODS OF DIRECTIONAL DRILLING

(75) Inventors: Kjell Haugvaldstad, Vanvikan (NO); Ashley Johnson, Milton (GB); Geoffrey C. Downton, Gloucestershire (GB); Walter David Aldred, Cambridgeshire (GB); Frank F. Espinosa, Cambridge (GB); Benjamin Jeffryes, Cambridge (GB); Riadh Boualleg, Cambridge (GB); Michael Paul Barrett, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 242 days.

(21) Appl. No.: 12/635,880

(22) Filed: Dec. 11, 2009

(65) Prior Publication Data

US 2011/0139512 A1 Jun. 16, 2011

(51) Int. Cl.
*E21B 7/08* (2006.01)

(52) U.S. Cl. ..... 175/61; 175/74

(58) Field of Classification Search ..... 60/325, 60/407; 175/61, 62, 74
See application file for complete search history.

(56) References Cited

U.S. PATENT DOCUMENTS 3,466,079 A * 9/1969 Mammel ..... 294/64.3
4,630,244 A 12/1986 Larronde
5,113,953 A 5/1992 Noble
5,265,682 A 11/1993 Russell et al.
5,520,255 A 5/1996 Barr et al.
5,553,678 A 9/1996 Barr et al.
5,553,679 A 9/1996 Thorp
5,582,259 A 12/1996 Barr
5,603,385 A 2/1997 Colebrook
5,673,763 A 10/1997 Thorp
5,685,379 A 11/1997 Barr et al.
5,695,015 A 12/1997 Barr et al.
5,706,905 A 1/1998 Barr
5,778,992 A 7/1998 Fuller
5,803,185 A 9/1998 Barr et al.
5,971,085 A 10/1999 Colebrook
5,979,475 A * 11/1999 Satoh et al. ..... 134/140
6,089,332 A 7/2000 Barr et al.
6,092,610 A 7/2000 Kosmala et al.
6,158,529 A 12/2000 Dorel
6,244,361 B1 6/2001 Comeau et al.
6,364,034 B1 4/2002 Schoeffler
6,394,193 B1 5/2002 Askew
6,422,801 B1 * 7/2002 Solomon ..... 414/416.07
6,601,888 B2 * 8/2003 McIlwraith et al. ..... 294/64.3
7,188,685 B2 3/2007 Downton et al.
7,192,242 B2 * 3/2007 Baba ..... 414/749.3
7,516,995 B2 * 4/2009 Jaksic ..... 294/64.3
2001/0052428 A1 12/2001 Larronde et al.
2002/0011359 A1 1/2002 Webb et al.
2003/0127252 A1 * 7/2003 Downton et al. ..... 175/73
2006/0131030 A1 6/2006 Sheffield (Continued)

*Primary Examiner* — William P Neuder
*Assistant Examiner* — Blake Michener
(74) *Attorney, Agent, or Firm* — Jeremy Welch

(57) ABSTRACT

The present invention recites a method and apparatus, wherein said methods and apparatus comprises an actuator comprising a first plate, a pocket extending through the first plate, the pocket in fluid communication with a pressurized fluid source and a second plate coupled to a component that is to be actuated, wherein the first plate, the second plate, and the pocket are dimensioned such that when a pressurized fluid is discharged through the pocket, the velocity of the fluid through a gap between the first plate and the second plate creates a pressure drop sufficient to pull the second plate toward the first plate.

12 Claims, 11 Drawing Sheets

U.S. PATENT DOCUMENTS

2007/0154341 A1 7/2007 Saenger
2007/0242565 A1 10/2007 Hall et al.
2010/0052343 A1* 3/2010 Hallett et al. ..... 294/1.1

* cited by examiner

ACTUATORS, ACTUATABLE JOINTS, AND METHODS OF DIRECTIONAL DRILLING

BACKGROUND

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

The present invention is filed concurrently with application Ser. No. 12/635,875 titled GAUGE PADS, CUTTERS, ROTARY COMPONENTS, AND METHODS FOR DIRECTIONAL DRILLING, that is herein incorporated by reference.

SUMMARY OF THE INVENTION

In accordance with the present invention an actuator comprising a first plate, a pocket extending through the first plate, the pocket in fluid communication with a pressurized fluid source and a second plate coupled to a component that is to be actuated, wherein the first plate, the second plate, and the pocket are dimensioned such that when a pressurized fluid is discharged through the pocket, the velocity of the fluid through a gap between the first plate and the second plate creates a pressure drop sufficient to pull the second plate toward the first plate is recited. As recited in one embodiment of the present invention, the pocket of said actuator may have a substantially circular profile. Additionally, the first plate of said actuator may have a substantially circular profile, and the second plate may have a substantially circular profile. Furthermore, the first and/or the second plate may be substantially smooth.

In accordance with aspects of the present invention the pressurized fluid may be mud, a gas or some combination thereof. Additionally, a controller may be associated with said actuator in accordance with embodiments of the present invention such that said controller selectively permits fluid flow from the pocket. Additionally, in accordance with the present invention the second plate may be coupled with a lever arm.

In accordance with an alternative embodiment of the present invention, an actuatable joint comprising a first joint member including one or more first plates, each first plate including a pocket in fluid communication with a fluid source and a second joint member including one or more second plates, each of the second plates corresponding to one of the one or more first plates wherein the first plates, the second plates, and the pocket are dimensioned such that when a pressurized fluid is discharged through the pocket of one of first plates, the velocity of the fluid through a gap between the first plate and the second plate creates a pressure drop sufficient to pull the second plate toward the first plate, thereby actuating the joint is recited. In accordance with this embodiment, the pressurized fluid may be mud, a gas or some combination thereof. Furthermore, a controller configured to selectively permit fluid flow from the one or more pockets may be associated with said actuator.

In accordance with another embodiment of the present invention, a method of directional drilling comprising the steps of providing a drill string including an actuatable joint including a first joint member including one or more first plates, each first plate including a pocket in fluid communication with a fluid source and a second joint member including one or more second plates, each of the second plates corresponding to one of the one or more first plates wherein the first plates, the second plates, and the pocket are dimensioned such that when a pressurized fluid is discharged through the pocket of one of first plates, the velocity of the fluid through a gap between the first plate and the second plate creates a pressure drop sufficient to pull the second plate toward the first plate and selectively permitting fluid to flow from one or more pockets to actuate the joint is recited herein.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

Embodiments of the invention provide gauge pads, cutters, rotary components, and methods for directional drilling. Various embodiments of the invention can be used in wellsite systems.

Wellsite System

Figure 1:
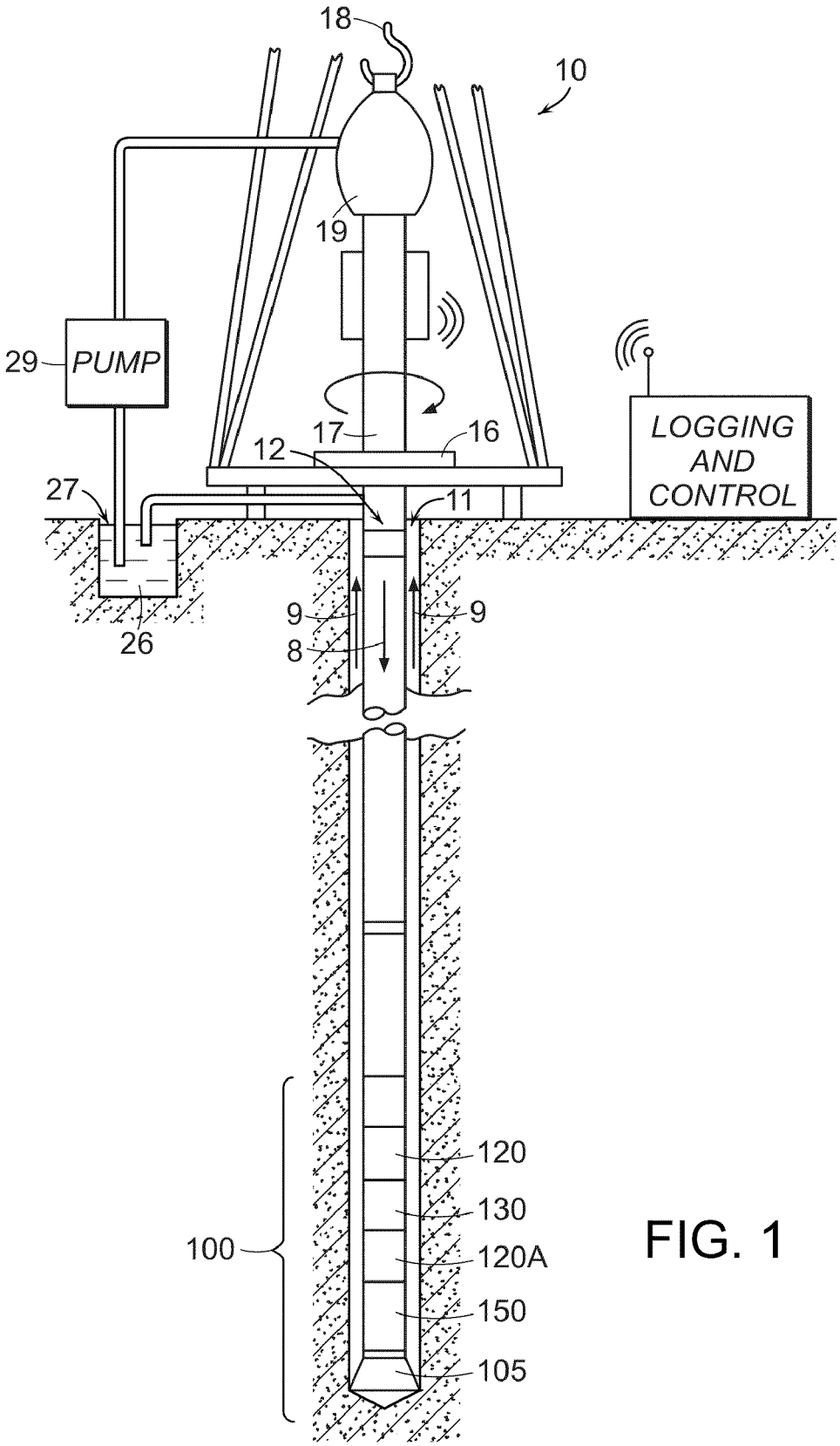
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form, the drill bit is required to cut side ways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Bernoulli Gauge Pads

Figure 2A:
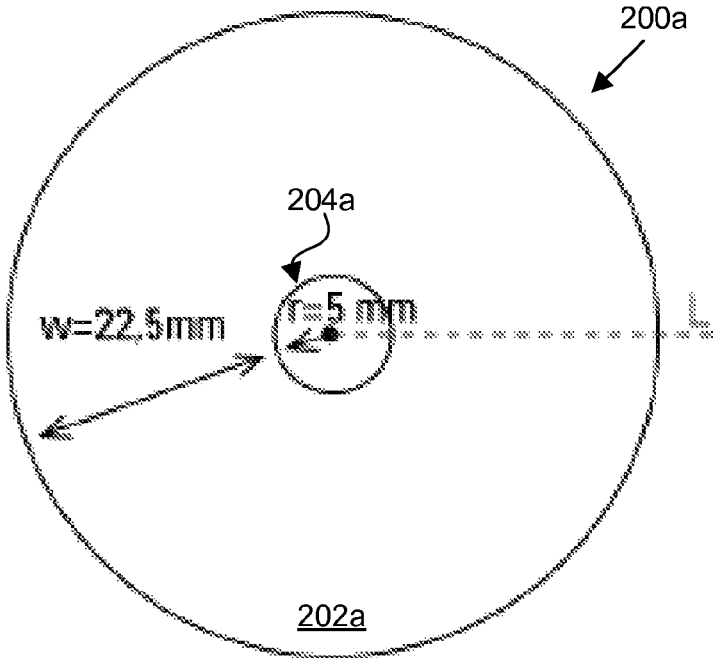
FIGS. 2A and 2B depict the operation of a Bernoulli gauge pad according to an embodiment of the invention.

Referring now to FIG. 2A, the principles of a Bernoulli gauge pad 200 are demonstrated. A Bernoulli gauge pad includes an exterior surface 202 and a pocket 204.

An embodiment of a Bernoulli gauge pad 200 having a cylindrical exterior surface 202 and pocket 204 is depicted in FIG. 2A. The pocket 204 has a radius of 5 mm. The exterior surface 202 surrounds the pocket 204 with a width of 22.5 mm.

Bernoulli gauge pad 200 utilizes Bernoulli's principle (which states that for an inviscid flow, an increase in the speed of the fluid occurs simultaneously with a decrease in pressure of a decrease in the fluid's potential energy) to pull a rotary component coupled with the Bernoulli gauge pad 200 toward the Bernoulli gauge pad 200.

Figure 2B:
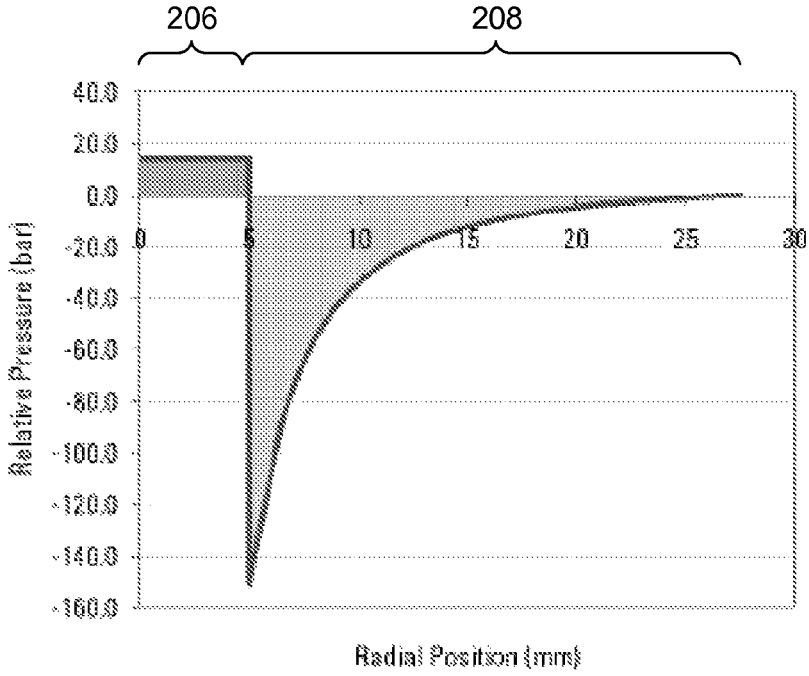

FIG. 2B depicts the pressure profile across the Bernoulli gauge pad 200. The plot of FIG. 2B is based on an analytical model using Bernoulli's equation for the Bernoulli gauge pad described above with a 0.6 mm gap between the exterior surface 202 and the borehole wall and a flow rate of water of 200 L/min (52 GPM) and was confirmed by computational flow dynamics (CFD) analysis of a variety of Bernoulli gauge pads 200, gaps, and flow rates. Because drilling fluids (e.g., mud) are shear-thinning and the shear rates as the mud flows across the exterior surface 202 are very high, the effective viscosity and frictional losses are both low.

FIG. 2B demonstrates that the relative pressure changes significantly across the Bernoulli gauge pad 200 due to the acceleration of the drilling fluid across the exterior surface 202. Region 206, which corresponds to the pocket 204 has a slightly higher pressure relative to annular pressure between the rotary component and a borehole wall. However, region 208, which corresponds to the exterior surface 202 has a significantly lower (i.e., negative) pressure relative to the annular pressure. This is particularly true for the region of the exterior surface closest to the pocket 204.

The net pressure for the Bernoulli gauge pad can be determined by integrating the pressure profile, which produces a net negative pressure of about 15 bar and net steering force of about 3 kN. Accordingly, the low pressure zone created by the exterior surface 202 is sufficient to overcome the positive pressure created by fluid exiting from the pocket 204. If the Bernoulli gauge pad 200 is pulled closer to the wall of the borehole, the pressure drop and resultant steering force increases. For example, if the gap is reduced to 0.4 mm, the pressure drop is about 20 bar and the net steering force is about 7 kN. Likewise, if the gap is reduced to 0.3 mm, the pressure drop is about 30 bars and the net steering force is about 11 kN.

As the gap increases, the "pull" force weakens and eventually a "push" force from the fluid ejected from pocket 204 dominates to produce a net push force.

Figure 2C:
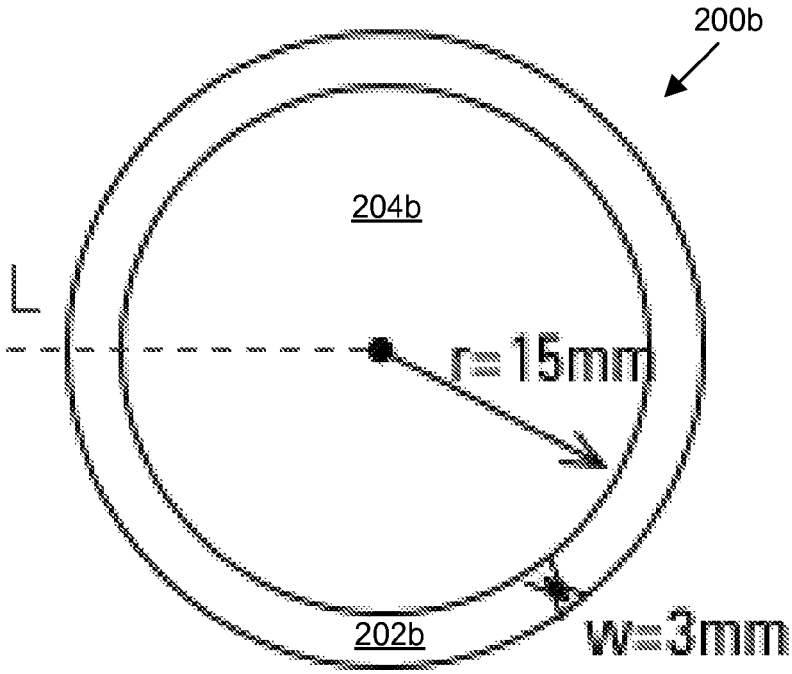
FIGS. 2C and 2D depict the operation of a push-type fluid steering device.

The resultant forces for Bernoulli gauge pad can also be adjusted by altering the dimensions of exterior surface 202 and pocket 204. For example, FIG. 2C depicts a push-type steering device 200*b* having a small (3 mm) exterior surface 202*b* and a large pocket (15 mm) 204*b*.

Figure 2D:
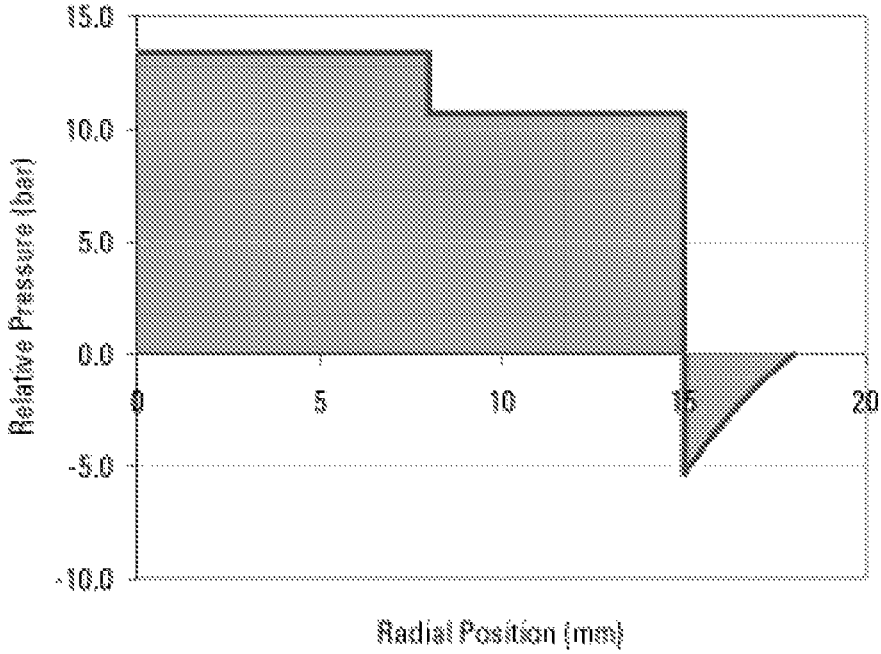

The pressure profile for push-type steering device 200*b* is depicted in FIG. 2D. For the same conditions discussed above (i.e., 200 L/min flow rate of water and a 0.6 mm gap), the pressure drop across the exterior surface 20 would be 13 bar and the net push force generated by push-type steering device 200*b* would be approximately 0.74 kN. Unlike a pull-type Bernoulli gauge pad 200*a*, the steering force of a push-type steering device 200*b* decreases as the push-type steering device 200*b* is actuated. At a 1 mm gap, a pressure drop of 6 bar is generated for a net push steering force of only 0.24 kN.

Figure 3:
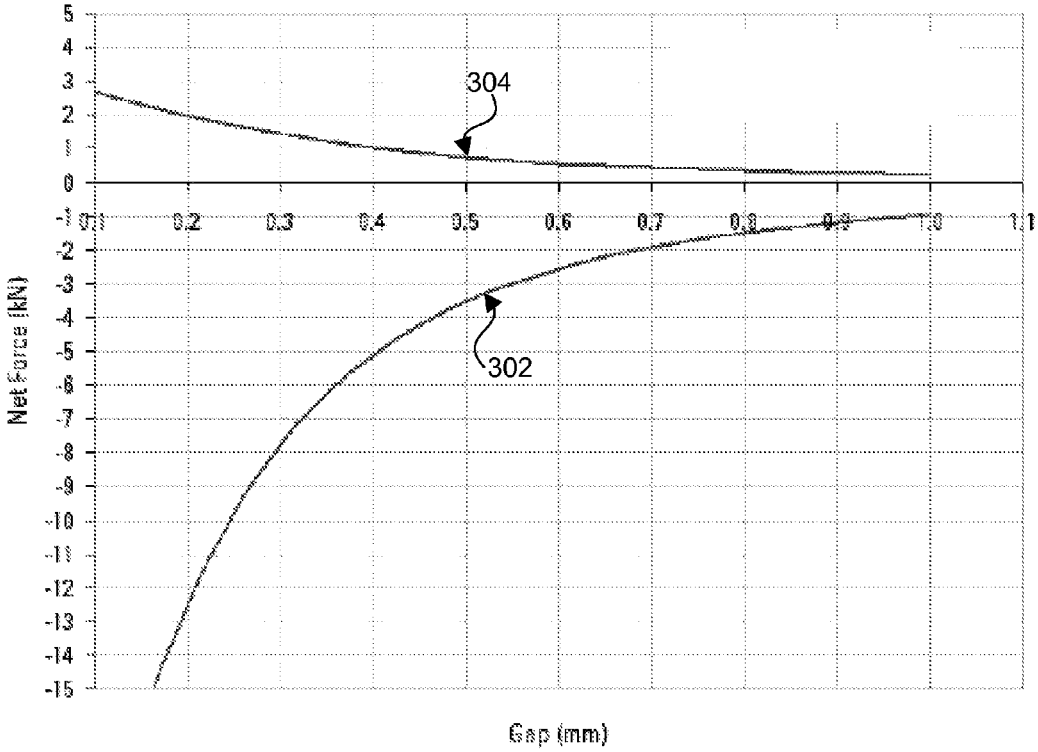
FIG. 3 depicts plots of net steering force for pull- and push-type steering devices for gap distances between 0.0 mm and 1.0 mm.

Referring now to FIG. 3, curves 302 and 304 are estimates of the net steering force is depicted for the pull-type for Bernoulli steering devices 200*a* and push-type steering device 200*b*, respectively, as described above. The model assumes the installation of a single steering device 200 on a MAX010™ steering assembly available from Schlumberger Technology Corporation of Sugar Land, Tex. The bore hole is 6.00 in, the flow rate of mud is 950 L/min (251 GPM), the mud viscosity is 1 cP, and the mud weight is 1 specific gravity (8.35 pounds per gallon. As clearly depicted in FIG. 3, the net steering force for a pull-type Bernoulli steering devices 200*a* (represented by curve 302) is greater than the net steering force for a push-type steering devices 200*b* (represented by curve 304) for gaps at least up to 1.0 mm. As result less fluid flow is required for a Bernoulli gauge pad 200*a* to achieve the same steering force as a push-type steering device 200*b*, which allows for more fluid to be reserved for the operation of other downhole components (e.g., mud motors, drill bits, and the like).

Figure 4A:
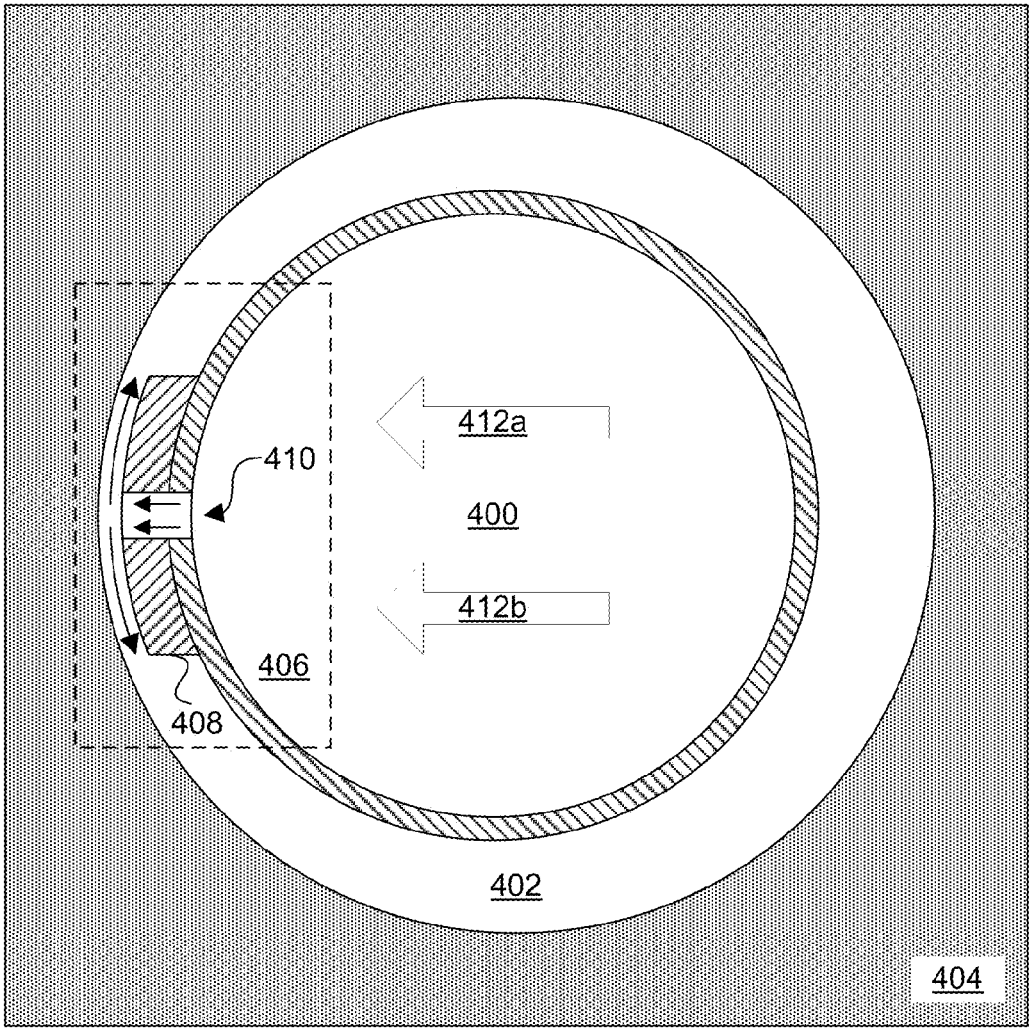
FIGS. 4A and 4B depict cross-sections of rotary components including a Bernoulli gauge pad according to embodiments of the invention.

Referring now to FIG. 4A, a rotary component 400 is received within a borehole 402 in a rock formation 404. Although the term "gauge pad" is traditionally associated with drill bits, rotary component 400 can be any component of a drill string 12 including, but not limited to, a drill bit 105 (e.g., bi-center, two-stage, and piloted drill bits). For example, Bernoulli gauge pads can be installed throughout the length of the drill string.

Rotary component 400 includes a Bernoulli gauge pad 406. Bernoulli gauge pad 406 includes an exterior surface 408 and a pocket 410 extending through the exterior surface. Pocket 410 extends through the exterior surface 408 and is in fluid communication with a pressurized fluid source (e.g., the interior cavity of the rotary component 400).

In some embodiments, exterior surface 408 is fabricated from and/or coated with a wear-resistant material such as steel, "high speed steel," carbon steel, brass, copper, iron, polycrystalline diamond compact (PDC), hardface, ceramics, carbides, ceramic carbides, cermets, and the like. Suitable coatings are described, for example, in U.S. Patent Publication No. 2007/0202350. Also, although exterior surface 408 is depicted as a separate material from rotary component 400, exterior surface can be an integral portion of rotary component 400. Additionally or alternatively, exterior surface 408 can have beveled or smooth edges to reduce frictions and/or damage to the gauge pad 406 as the rotary component 400 spins within the borehole 402.

When the Bernoulli gauge pad 406 is positioned in proximity to the borehole wall, the fluid velocity between the exterior surface 408 and the borehole wall exceeds fluid velocity within the pocket 410. This increase in velocity results in a drop in pressure between the exterior surface 408 and the borehole wall relative to the pocket pressure as described in Bernoulli's equation. This pressure drop pulls the rotary component 400 toward the exterior surface as depicted with arrows 412*a*, 412*b*.

Figure 4B:
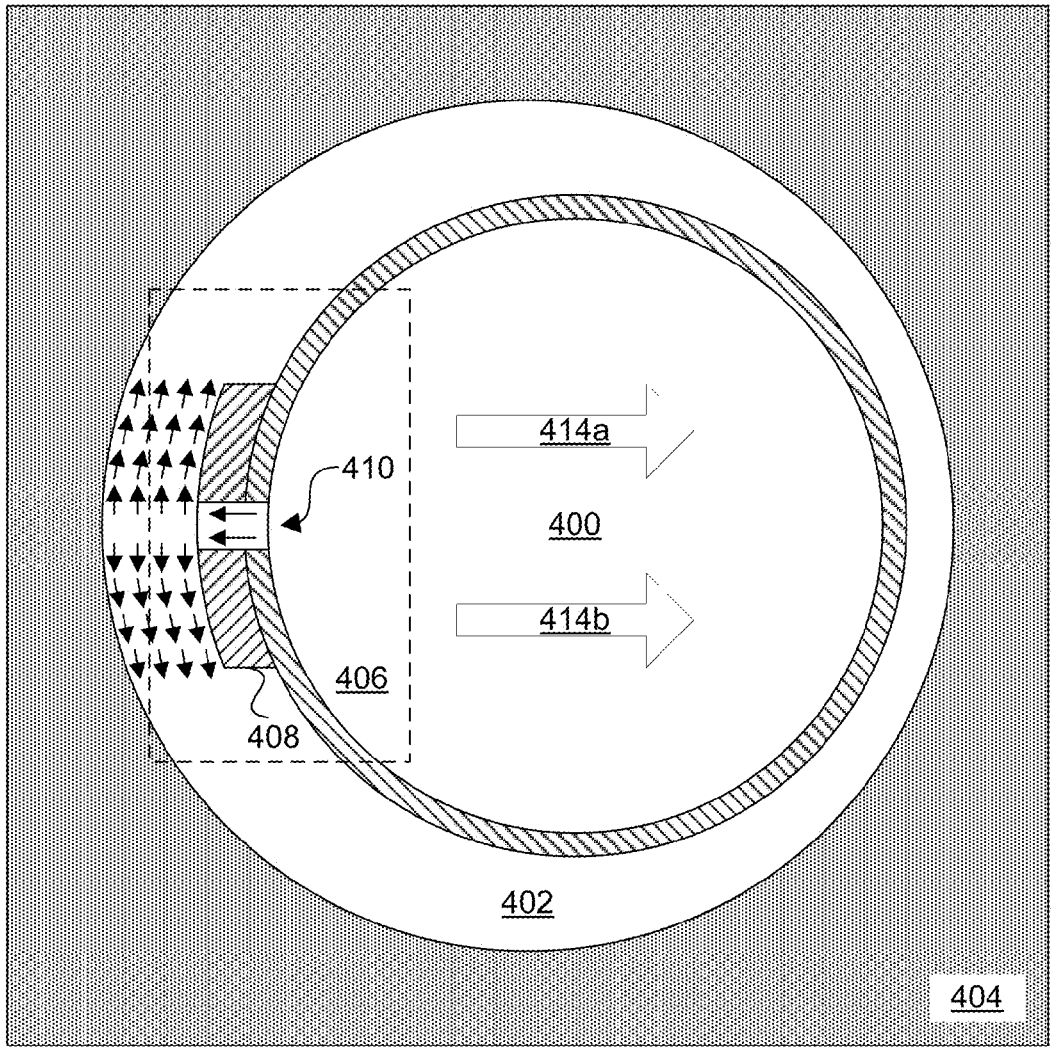
Figure 5A:
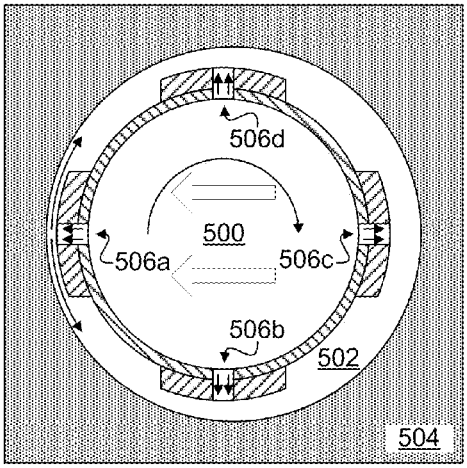
FIGS. 5A-D depict the operation of a rotary component including multiple Bernoulli gauge pads.
Figure 5B:
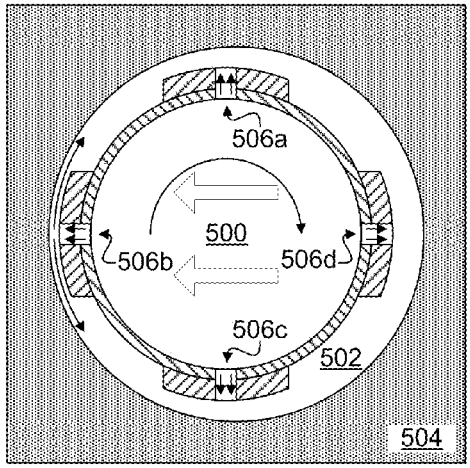
Figure 5C:
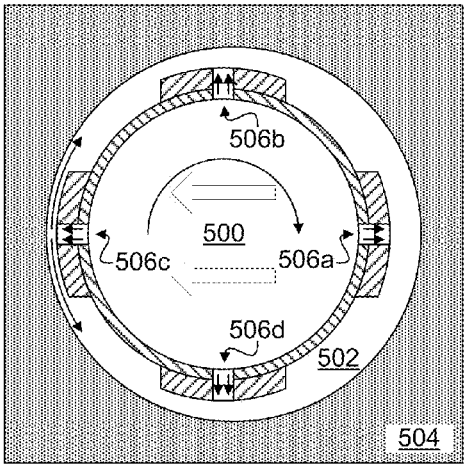
Figure 5D:
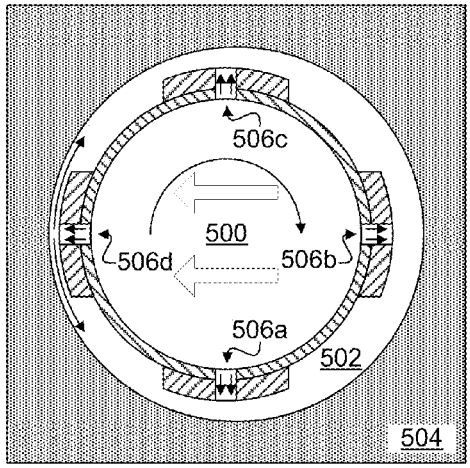

In contrast, as depicted in FIG. 4B, when the Bernoulli gauge pad 406 is positioned away from the borehole wall, the fluid velocity between the exterior surface 408 and the borehole wall is greater than or substantially equal to the fluid velocity within the pocket 410. In this situation, the pocket fluid flow generates a repulsive force to push the rotary component 400 away from the pocket and exterior surface as depicted by arrows 414*a*, 414*b*.

Referring now to FIGS. 5A-D, a rotary component 500 can include a plurality of Bernoulli gauge pads 506*a-d*. Bernoulli gauge pads 506*a-d* can be actuated individually by a control unit (not depicted) or can be configured to permit a substantially continuous flow of fluid.

In embodiments in which the Bernoulli gauge pads 506 are selectively actuated, the control unit can maintain the proper angular position of the bottom hole assembly relative to the subsurface formation. In some embodiments, the control unit is mounted on a bearing that allows the control unit to rotate freely about the axis of the bottom hole assembly. The control unit, according to some embodiments, contains sensory equipment such as a three-axis accelerometer and/or magnetometer sensors to detect the inclination and azimuth of the bottom hole assembly. The control unit can further communicate with sensors disposed within elements of the bottom hole assembly such that said sensors can provide formation characteristics or drilling dynamics data to control unit. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the bottom hole assembly.

In some embodiments, control unit is programmed above ground to following a desired inclination and direction. The progress of the bottom hole assembly can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWER-PULSE™ trademark from Schlumberger Technology Corporation of Sugar Land, Tex.

In order to urge the bottom hole assembly rotary component 500, one or more Bernoulli gauge pads 506 can be selectively actuated with respect to the rotational position of the Bernoulli gauge pad 506. For illustration, FIG. 5 depicts a borehole 502 within a subsurface formation 504. A cross section of rotary component 500 is provided to illustrate the placement of Bernoulli gauge pads 506. In this example, an operator seeks to move rotary component 500 (rotating clockwise) towards a point located entirely within the negative x direction relative to the current position of rotary component 500. Although Bernoulli gauge pad 506*a* will generate a force vector having a negative x-component if Bernoulli gauge pad 506*a* is actuated at any point when Bernoulli gauge pad 506*a* is located on the same side of borehole 502 as point the target (i.e., on the negative x side of the borehole 502), Bernoulli gauge pad 506*a* will generate the maximum amount of force in the negative x direction if actuated when immediately adjacent to the target direction. Accordingly, in some embodiments, the actuation of Bernoulli gauge pad 506*a* is approximately periodic and/or sinusoidal, wherein the Bernoulli gauge pad 506*a* begins to produce a pull force as Bernoulli gauge pad 506*a* enters the negative x portion of the borehole 502 (i.e., about 90° prior to the target direction), reaches maximum power at the target direction, and ceases actuation before entering the positive x portion of borehole 502 (i.e., about 90° after the target direction).

In embodiments with multiple Bernoulli gauge pads 506, the actuation of Bernoulli gauge pads 506 can be coordinated to steer the rotary component 500 in a desired direction. For example, the actuation profile of Bernoulli gauge pad 506*a* can be repeated by Bernoulli gauge pads 506*b*, 506*c*, and 506*d* at 90°, 180°, and 270° offsets, respectively.

In some embodiments, a rotary valve (also referred to a spider valve) can be used to selectively actuate Bernoulli gauge pads 506. Suitable rotary valves are described in U.S. Pat. Nos. 4,630,244; 5,553,678; 7,188,685; and U.S. Patent Publication No. 2007/0242565.

In another embodiment, fluid flows continuously from Bernoulli gauge pads 506. Such an embodiment can be deployed to enhance the steering provided by other drill string components (e.g., pads and the like). As other steering components move the drill string, the Bernoulli gauge pad 506 closest to the target direction will be brought in proximity to the borehole wall to produce a pull force to enhance steering. It is estimated that such enhancements could increase steering angles about 0.5°. Such increases in steering angles significantly reduce drilling time and expense over curved well bores spanning several miles.

The Bernoulli gauge pads described herein also have a variety of other benefits. For example, the large exterior surface of Bernoulli gauge pads increases the mechanical robustness of the gauge pads relative to push-type devices with small exterior surfaces.

Additionally, if erosion of the borehole wall occurs when a Bernoulli gauge pad is used, the erosion will occur in the desired direction of steering. In contrast, erosion from a push-type steering device will occur opposite to the desired direction of steering.

Bernoulli Cutters

Figure 6:
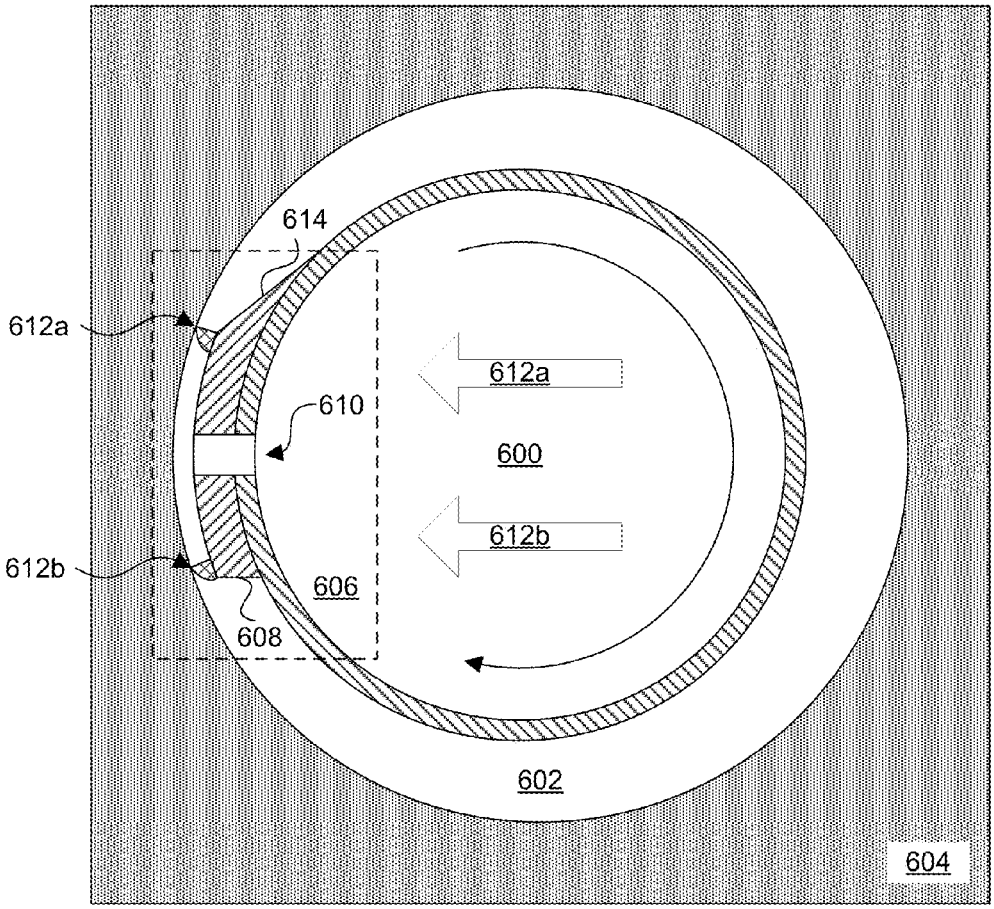
FIG. 6 depicts a cross-section of a rotary component including a Bernoulli cutter.

Referring now to FIG. 6, a cross section of a rotary component 600 having a Bernoulli cutter 606 is depicted. Bernoulli cutter 606 includes similar features to the Bernoulli gauge pads described herein plus one or more cutter bits 612*a*, 612*b* position on exterior surface 608.

Cutter bits 612 engage the borehole wall to enlarge and/or smooth the borehole while the flow of fluid over the exterior surface 608 creates a pressure drop that pulls the rotary component 600 toward the cutter bits 612 to enhance cutting. Cutter bits 612 can be positioned on the leading and/or trailing edges of exterior surface 608 and can be composed of a variety of materials such as polycrystalline diamond compact (PDC), ceramics, carbides, cermets, and the like. In some embodiments, exterior surface 608 includes a tapered region 614 to minimize friction and damage during rotation. Tapered regions 614 can be included in all embodiments of Bernoulli gauge pads and Bernoulli cutters described herein.

Bernoulli Actuators and Joints

Figure 7A:
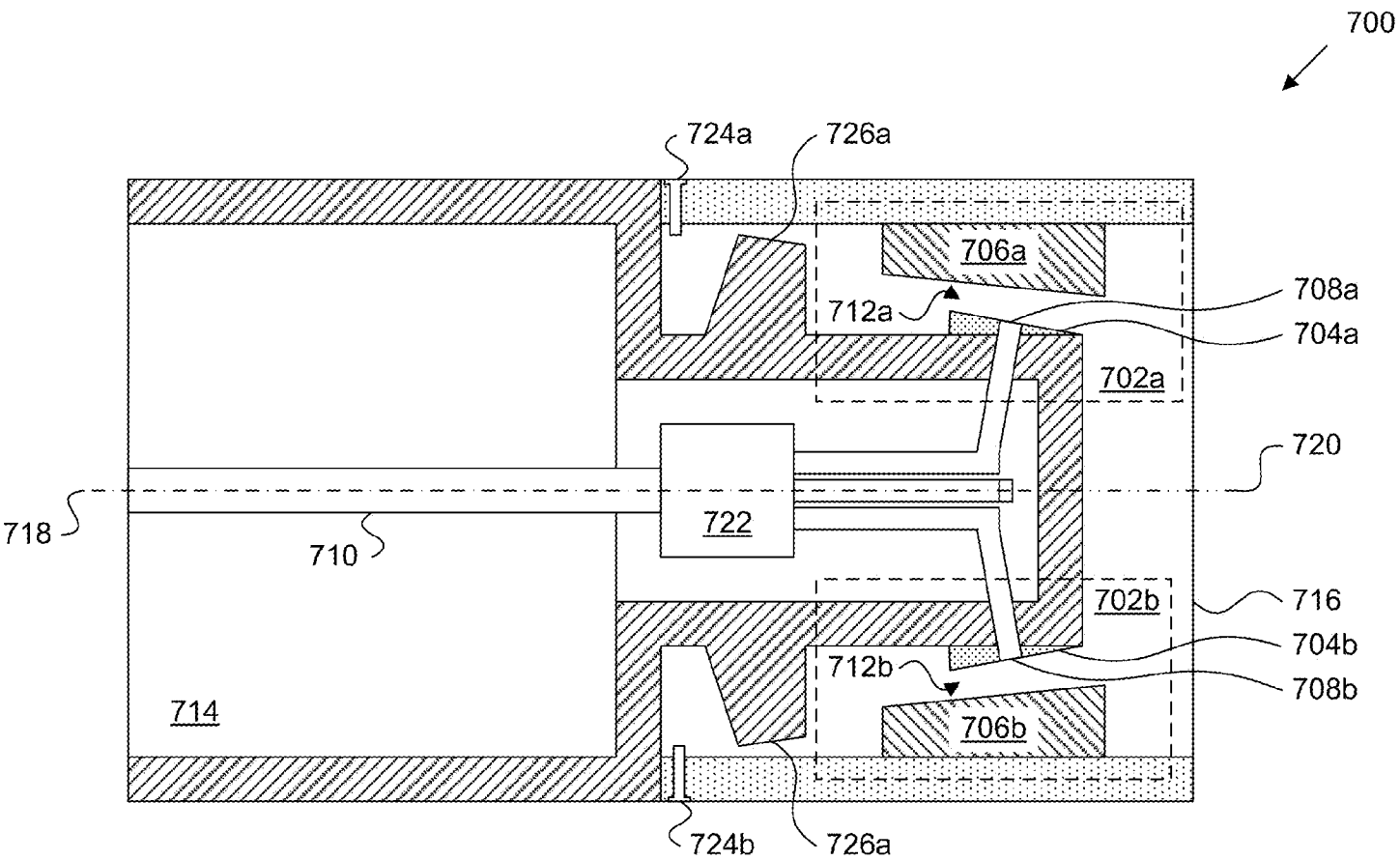
FIGS. 7A-7C depict a cross-section of a joint containing a plurality of Bernoulli actuators.
Figure 7B:
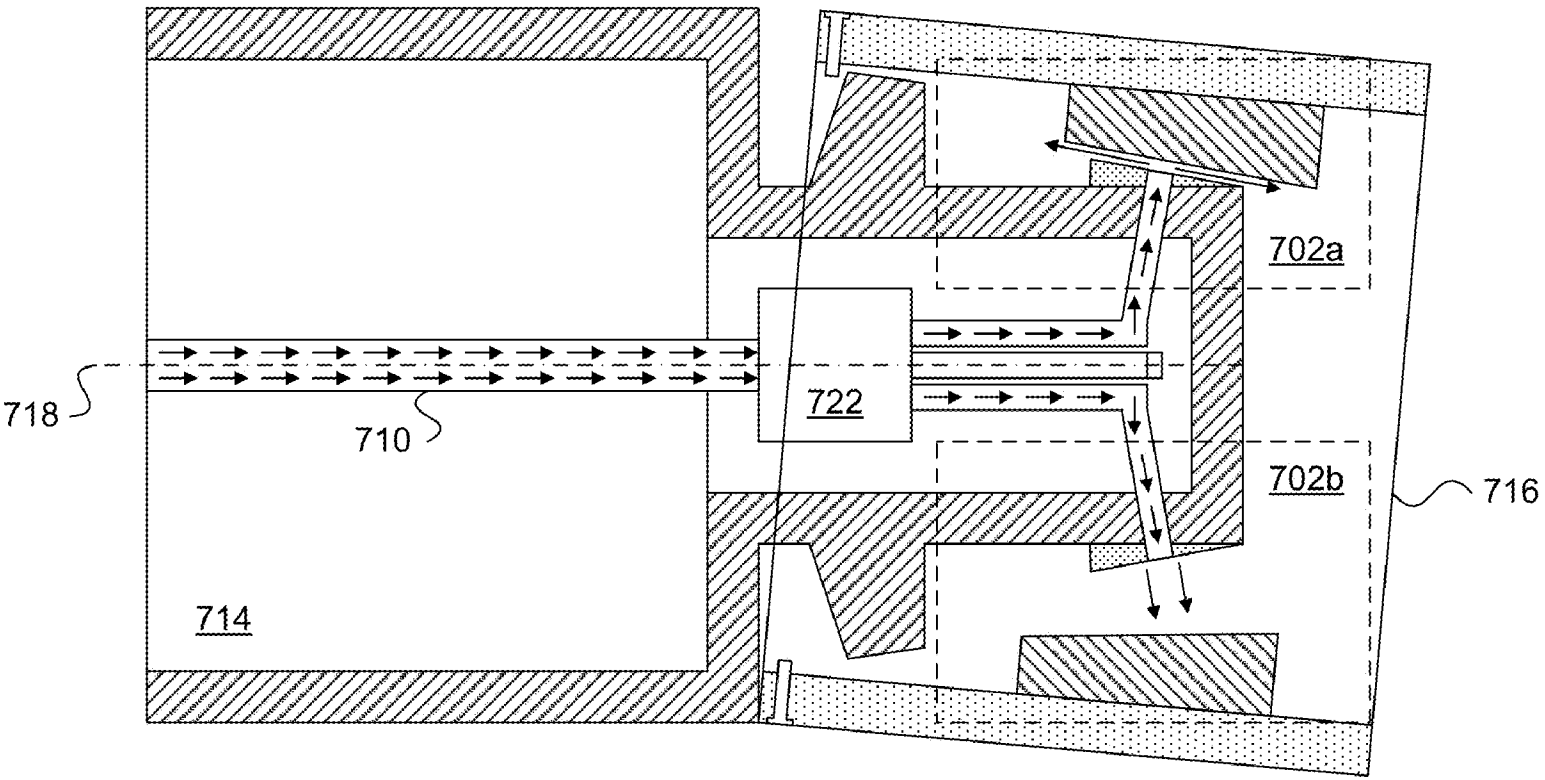

Referring now to FIGS. 7A and 7B, a joint 700 is provided with multiple Bernoulli actuators 702. Although described in the context of a drill string, embodiments of the joint 700 are applicable to a variety of applications.

Each Bernoulli actuator 702 includes a first plate 704 and a second plate 706. A pocket 708 extends through the first plate 704 and is in fluid communication with a pressurized fluid source 710. The first plate 704, the second plate 706, and the pocket 708 are dimensioned such that when a pressurized fluid is discharged through the pocket 708, the velocity of the fluid through a gap 712 between the first plate 704 and the second plate 706 creates a pressure drop sufficient to pull the second plate 706 toward the first plate 704.

As discussed herein in the context of Bernoulli gauge pads, embodiments of the first plate 704, second plate 706, and/or pocket 708 can have a substantially circular profile and/or substantially smooth surfaces.

A variety of fluids can be used to actuate the Bernoulli actuators 702. In some embodiments, the fluid is a drilling fluid such as mud, aerated mud, stable foam, unstable foam, air, gases, and the like.

One or more Bernoulli actuators 702 can be mounted within a joint in drill string 700 to effect and/or assist in steering of the drill string 700. For example, first plate 704 can be mounted on a male joint member 714 and second plate 706 can be mounted on within a female joint member 716. Although plates 704, 706 in FIGS. 2A and 2B are angled with respect to the longitudinal axes 718, 720 of joint members 714, 716, plates can be mounted in variety of orientations including parallel and perpendicular to longitudinal axes 718, 720.

In some embodiments depicted in FIG. 7B, fluid flows continuously to Bernoulli actuators 702. Such an embodiment can enhance steering of drill string by other drill string components (e.g., pads and the like). As other steering components cause the joint 700 to flex in the desired direction, the plates 704*a*, 706*a* of the Bernoulli actuator 702*a* closest to the target direction will be brought in proximity to each other to produce a pull force to enhance steering. Additionally, fluid in other Bernoulli actuators 702*b* can push the second plate 706*b* to further enhance steering. It is estimated that such enhancements could increase steering angles about 0.5°.

Such increases in steering angles significantly reduce drilling time and expense over curved well bores spanning several miles.

Figure 7C:
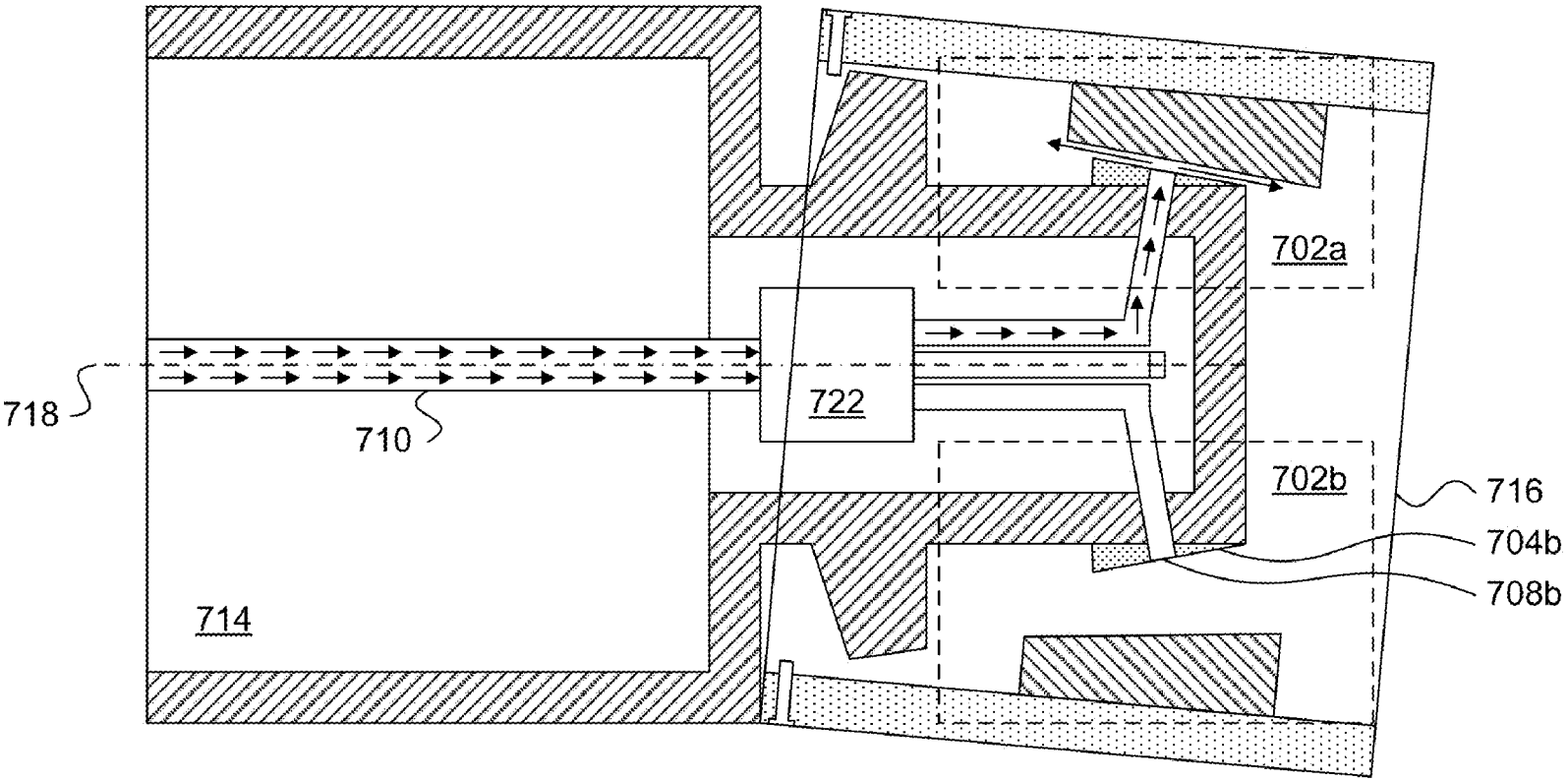

In other embodiments depicted in FIG. 7C, Bernoulli actuators 702 are actuated individually by a control unit 722 to maintain the proper angular position of the joint 700 relative to the subsurface formation. In some embodiments, the control unit 722 is mounted on a bearing that allows the control unit 722 to rotate freely about the axis of the drill string. The control unit 722, according to some embodiments, contains sensory equipment such as a three-axis accelerometer and/or magnetometer sensors to detect the inclination and azimuth of the drill string. The control unit 722 can further communicate with sensors disposed within elements of the drill string such that said sensors can provide formation characteristics or drilling dynamics data to control unit 722. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the drill string.

In some embodiments, control unit 722 is programmed above ground to following a desired inclination and direction. The progress of the drill string can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWER-PULSE™ trademark from Schlumberger Technology Corporation of Sugar Land, Tex.

In some embodiments, a rotary valve (also referred to a spider valve) can be used to selectively actuate Bernoulli actuators 702. Suitable rotary valves are described in U.S. Pat. Nos. 4,630,244; 5,553,678; 7,188,685; and U.S. Patent Publication No. 2007/0242565.

In some embodiments, flexation of joint 700 can be regulated by various joint members such as pins 724 on the female member 716 with ridges 726 on male member 714.

One skilled in the art will readily recognize that the present invention may be utilized for a variety of additional applications in accordance with that which is claimed herein. In one embodiment, one or more cutters may be disposed in advance of the pad arrangement recited herein such that the borehole wall is cut to provide a smooth surface for the present invention to act upon. Additionally in an embodiment wherein a valve arrangement is disposed to actuation one or a plurality of gauge pads or actuators, the valve arrangement may serve as a suitable device to impart the required pressure drop for operation of the gauge pad or actuator. In an alternative embodiment, the aforementioned pressure drop may be achieved using a restrictor (not shown), wherein the restrictor may be manufactured using a variety of methods as understood by one skilled in the art. One suitable, but not exclusive, material is TSP. In accordance with one embodiment, this TSP arrangement may be infiltrated into the drill bit matrix during manufacture. Alternatively, the pocket arrangement of the present invention may serve as the suitable restrictor.

In accordance with further aspects of the present invention, the gap region of the present invention may be profiled such that the fluid passing through said gap is preferentially controlled. In one embodiment, the gap region may be profiled, as understood by one skilled in the art, to increase the diffusion effect of the fluid. In an alternative embodiment, the gap region may be profiled such that the tendency for the flow to separate in the region of the gap is decreased.

In accordance with alternative embodiments of the present invention, a standoff may be provided such that the gap region is sufficiently maintained. As understood by one skilled in the art, said standoff may be of a sufficiently had material, such as TSP.

INCORPORATION BY REFERENCE

All patents, published patent applications, and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

The invention claimed is:

1. An actuator comprising:

a first plate mounted in a drill string;

a pocket extending through the first plate, the pocket in fluid communication with a pressurized fluid source; and a second plate positioned adjacent to the first plate;

wherein the first plate, the second plate, and the pocket are dimensioned such that when a pressurized fluid is discharged through the pocket, the velocity of the fluid through a gap between the first plate and the second plate creates a pressure drop sufficient to steer the drill string by pulling the second plate toward the first plate.

2. The actuator of claim 1, wherein the pocket has a substantially circular profile.

3. The actuator of claim 1, wherein the first plate has a substantially circular profile.

4. The actuator of claim 1, wherein the second plate has a substantially circular profile.

5. The actuator of claim 1, wherein the first plate is substantially smooth.

6. The actuator of claim 1, wherein the second plate is substantially smooth.

7. The actuator of claim 1, wherein the pressurized fluid is mud.

8. The actuator of claim 1, wherein the pressurized fluid is a gas.

9. The actuator of claim 1, wherein the second plate is coupled with a lever arm.

10. An actuatable joint in a drill string comprising:

a first joint member including one or more first plates, each first plate including a pocket in fluid communication with a fluid source; and a second joint member including one or more second plates, each of the second plates corresponding to one of the one or more first plates;

wherein the first plates, the second plates, and the pocket are dimensioned such that when a pressurized fluid is discharged through the pocket of one of first plates, the velocity of the fluid through a gap between the first plate and the second plate creates a pressure drop sufficient to pull the second plate toward the first plate, thereby actuating the joint, wherein the pressurized fluid is mud.

11. The actuatable joint of claim 10, further comprising:

a controller configured to selectively permit fluid flow from the one or more pockets.

12. A method of directional drilling comprising:

providing a drill string including an actuatable joint including:

a first joint member including one or more first plates, each first plate including a pocket in fluid communication with a fluid source; and a second joint member including one or more second plates, each of the second plates corresponding to one of the one or more first plates;

wherein the first plates, the second plates, and the pocket are dimensioned such that when a pressurized fluid is discharged through the pocket of one of the first plates, the velocity of the fluid through a gap between the first plate and the second plate creates a pressure drop sufficient to pull the second plate toward the first plate; and selectively permitting fluid to flow from one or more pockets to actuate the joint, thereby steering and directionally drilling with the drill string.

* * * * *